US005425581A

United States Patent [19]

Palm

[11] Patent Number: 5,425,581

[45] Date of Patent: Jun. 20, 1995

[54] STATIC MIXER WITH TWISTED WING-SHAPED MIXING ELEMENTS

[75] Inventor: Bengt Palm, Genarp, Sweden

[73] Assignee: Tetra Laval Holdings & Finance S.A., Pully, Sweden

[21] Appl. No.: 169,051

[22] Filed: Dec. 20, 1993

[30] Foreign Application Priority Data

Dec. 21, 1992 [SE] Sweden ..... 9203842

[51] Int. Cl.[6] ..... B01F 5/00

[52] U.S. Cl. ..... 366/339; 138/37

[58] Field of Search ..... 366/336-340; 48/189.4; 138/37-39

[56] References Cited

U.S. PATENT DOCUMENTS

| | | | |
|---|---|---|---|
| 1,703,867 | 3/1929 | Bursley et al. | 48/189.4 X |
| 1,778,790 | 10/1930 | Brandl et al. | 138/37 X |
| 2,200,723 | 5/1940 | Reichhelm et al. | 48/189.4 |
| 2,361,150 | 10/1944 | Petroe | 138/37 X |
| 2,740,616 | 4/1956 | Walden | 366/336 |
| 2,747,844 | 5/1956 | Slayter | 366/336 X |
| 2,925,830 | 2/1960 | Kantrowitz | 138/37 |
| 3,167,305 | 1/1965 | Backx et al. | 366/340 X |
| 3,286,992 | 11/1966 | Armeniades et al. | 366/339 |
| 3,671,208 | 6/1972 | Medsker | 48/189.4 X |
| 4,099,268 | 7/1978 | Luthi | 366/338 |
| 4,230,410 | 10/1980 | Kastl et al. | 366/177 |
| 4,408,893 | 10/1983 | Rice, III | 366/339 |
| 4,466,741 | 8/1984 | Kojima | 366/339 |

FOREIGN PATENT DOCUMENTS

| | | | |
|---|---|---|---|
| 2237474 | 3/1973 | Germany . | |
| 2805576 | 9/1979 | Germany . | |
| 3539426 | 5/1987 | Germany . | |
| 28149 | 10/1932 | Netherlands | 48/189.4 |
| 2080692 | 2/1982 | United Kingdom | 366/339 |

*Primary Examiner*—David A. Scherbel
*Assistant Examiner*—Charles Cooley
*Attorney, Agent, or Firm*—Davis Hoxie Faithfull & Hapgood

[57] ABSTRACT

A static mixer for mixing of different media comprises mixing elements arranged within a tube, at which the mixing elements are twisted to divide and divert the media. The mixer is constructed of units each comprising at least one mixing element (1) arranged within a tube part (4). The mixing element is firmly connected to the tube part along its whole length of extension. The mixing elements seen in a cross-section has wing shape with the largest cross-section in the front part (2) of the element seen in the direction of flow of the media, while the rear part (3) seen in the flow direction has a thinner cross-section.

10 Claims, 3 Drawing Sheets

STATIC MIXER WITH TWISTED WING-SHAPED MIXING ELEMENTS

FIELD OF THE INVENTION

The present invention relates to a static mixer for continuous mixing of different media.

BACKGROUND OF THE INVENTION

Static mixers are commercially available and are used for mixing liquid/liquid or gas/liquid. The geometrical design of the mixers may vary but the main principle for the mixing is mainly the same. The mixer comprises stationary (unmovable) mixing elements and the media which are to be mixed are pumped to and through the mixer. From the beginning static mixers were from the beginning developed mainly for laminar flow. With laminar a flow mixing takes place when the mixing elements divide and divert the streams of different media a number of times. The necessary energy for the mixing is taken from the pumping energy. The number of mixing elements that are needed other things to obtain a desired degree of mixing depends among all of the mixing ability of the media. A higher number of elements are needed for more difficult mixing duty.

Early examples of static mixers are those described, for example, in U.S. Pat. No. 3,051,452 and U.S. Pat. No. 3,206,170. In the first mentioned patent there is described a static mixer which divides a flow through a tube into two concentric flows which are forced to flow radially inwardly and outwardly while the flows are divided into different partial streams. U.S. Pat. No. 3,206,170 describes mixing of two flows which are brought to flow through a number of elements with rectangular channels which are widened and divided into new channels which are widened and so on.

A static mixer with a low pressure drop is described in U.S. Pat. No. 3,286,992. This mixer comprises twisted mixing elements arranged within a tube. The mixing elements consist of discs which are twisted 60°–210°. The discs extend to the walls of the tube and divide the same into two separate channels. Each twisted disc is connected to the next disc. Static mixers with similar twisted elements are described in for example GB 1 386 955 and GB 2 127 316.

The static mixers described above work well for clean liquids but for liquid products comprising particles problems may arise as a consequence of the fact that the twisted mixing elements have sharp edges which may create blocking and problems with cleaning. This applies to an even greater extent if the material consists of food products containing fruit or vegetables which may be damaged by too sharp edges.

SUMMARY OF THE INVENTION

The present invention presents a solution to the problem of mixing and distribution of especially different kinds of food products. A static mixer according to the invention is mainly characterized in that the mixer is built up of units each comprising at least one mixing element arranged within a part of a tube. The mixing element is firmly connected to the tube part along its whole length. The mixing elements have a cross-section in the form of a wing or airfoil with the largest cross-section in the front portion of the element as seen in the direction of flow of the media, while the other portion of the element has a thinner cross-section.

With the mixing element so designed the risk that particles in a liquid product passing the mixer will be damaged is diminished. Because the mixer is also constructed with smooth edges the cleaning will be safer. The mixer may also easily be adapted to various mixing duties in that the number of units and consequently the mixing elements may vary.

Since the mixing elements are permanently joined to the tube part along the length of the elements the flow for the products are smooth and easily cleaned. As has been mentioned above this is of value especially for products comprising fibres.

A static mixer with the described "flow friendly" mixing elements may, even if it consists of a number of mixing elements, have a relatively low pressure drop. Usually the mixing in the proposed mixer takes place under laminar flow since the mixer is especially suitable to highly viscous products. Of course the mixing may also take place under turbulent flow if it is suitable for the product.

Advantageously the units are designed such that the mixing elements are arranged at a distance from the end of the tube parts, in such a way that a free space is created between the mixing elements when the units are assembled in a mixer. Such a design diminishes the risk of particles being caught.

The two streams which are to be mixed with each other may meet in a common pipe either immediately prior to the inlet to the mixer or at some distance from the inlet. It must not be a disadvantage to locate the mixing point at some distance from the inlet to the mixer in such a way that some tube bends are passed by the two not yet mixed flows.

Each mixing element may be twisted 75°–135° but a preferred twisting is 80°–100°. Too little twisting does not give a sufficient diversion of the streams which are to be mixed. Too large a twisting gives a poorer utilization of the available space.

The mixing elements are advantageously arranged such that every second mixing element is twisted clockwise and the other element counter clockwise. The desired diversion of the partial streams, is obtained when the products which are to be mixed meet the front part of the mixing element with a wing shape.

The mixing element is with advantageously designed such that it has a mainly semi-circular profile in its first front portion. In this way there is obtained a gentle diversion of the product mixture which is pumped through the tube.

A gentle handling of the product mixture is also obtained in that the mixing elements in profile have a continuously narrowing shape.

The number of tube parts including mixing elements may be adjusted to the mixing duty but is suitably 5–15 mixing elements, preferably 10–12 mixing elements. A highly viscous product demands a higher number of mixing elements. By constructing the mixer with a desired number of elements it is, for example, possible to obtain an incomplete mixing if one, for example, wants to be able to see one of the products within the other. In order to fulfil such a duty only a limited number of elements are needed.

The flanges of the tube parts are with advantage provided with guiding means in order to ensure a correct assembly. These guiding means may consist of notches and projections within the flanges. Of course various kinds of guide pins may also be used.

A mixer according to the invention may also be designed with double tube walls where the inner tube wall is perforated, which makes it possible to inject a heating medium as, for example, steam, directly into the products which are to be mixed.

A mixer of the kind described above may of course be used for many mixing duties but as has been mentioned above it is especially suitable for different kinds of food products comprising particles such as long fibres, spheres, cubes, rods and so on. The fibres may consist of fruit flesh or vegetable parts from orange, pineapple, mango, asparagus or tomato. The spherical particles may consist of peas, berries or small meat balls. The cubes may consist of cut carrots, potatoes or meat, the rods of wax beans, asparagus parts, pasta or noodles.

BRIEF DESCRIPTION OF THE DRAWINGS

The mixer according to the invention will be described further with reference to the attached drawings, in which.

DETAILED DESCRIPTION OF THE PREFERRED EMBODIMENT

Figure 1:
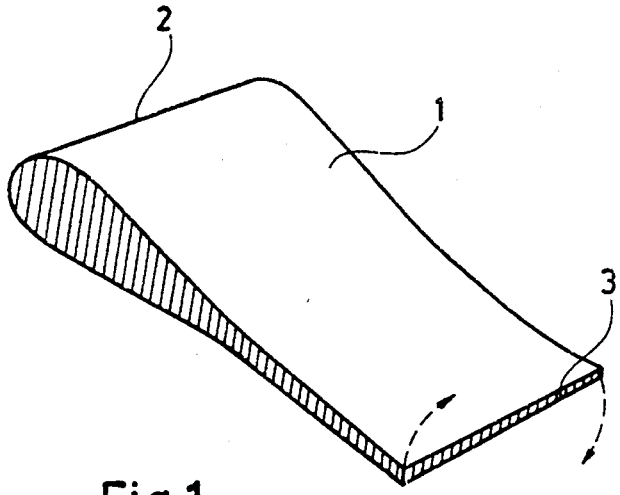
FIG. 1 shows a mixing element according to the invention prior to being twisted.

Referring to the drawings mixing unit 1 according to the invention, as may be seen in FIG. 1, has been designed with a streamlined symmetrical wing or airfoil shape with the largest cross-section in one front portion 2. Suitably this front portion 2 is designed such that it has a radius of at least 5 mm, preferably 7–10 mm if it is intended to be inserted in a tube with a diameter of 60 mm. With other dimensions of the tube the suitable curvature is increased or decreased in relation to a larger or smaller tube size.

Figure 2:
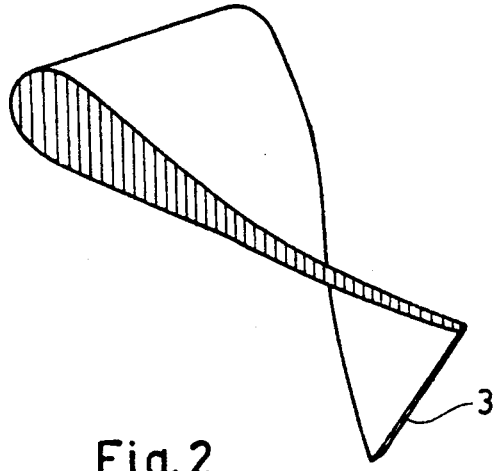
FIG. 2 shows a mixing element with its after part twisted 90° in relation to the front part.

As may be seen in FIG. 2 the rear part 3 of the wing is twisted for example 90° in relation to the front part. In the embodiments shown in the drawing the twist has consistently been 90°, but this is mainly due to the choice of technic for the drawing. Within the scope of the invention twisting may be 80°–100°. Also a larger or somewhat smaller twisting 75°–135° may be used if it is considered suitable.

Figure 5:
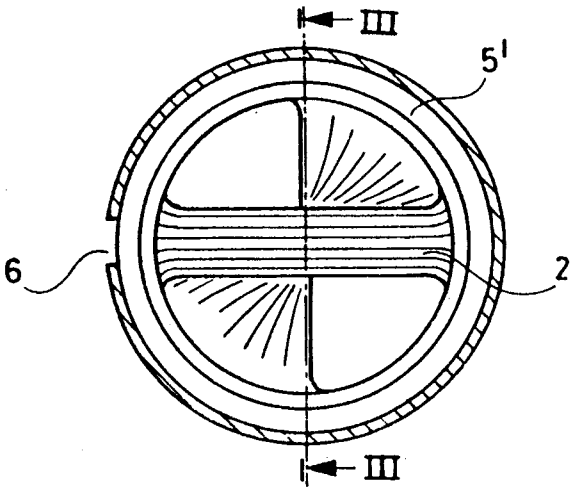
FIG. 5 is an end view, partly in vertical section, of the mixer of FIG. 3, taken along the line V—V of FIG. 3.
Figure 6:
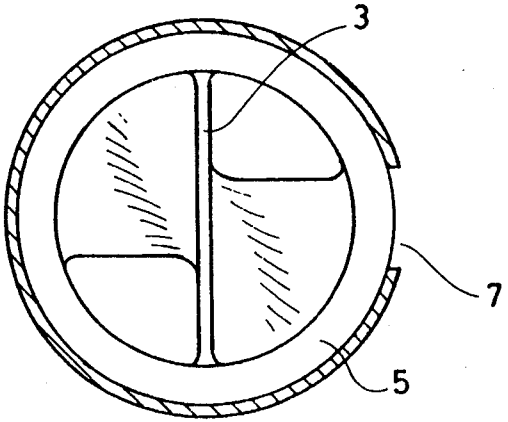
FIG. 6 is an end view, partly in vertical section, taken on the line VI—VI of FIG. 3.
Figure 3:
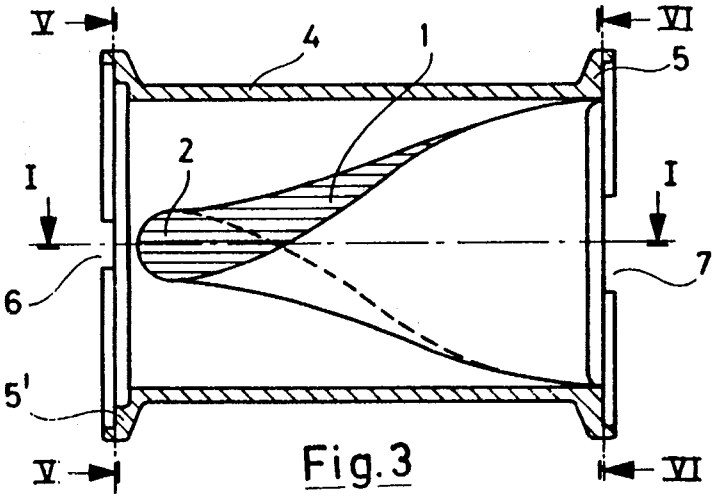
FIG. 3 is a view in vertical section of a static mixer according to the invention taken along line III—III in FIG. 5.
Figure 4:
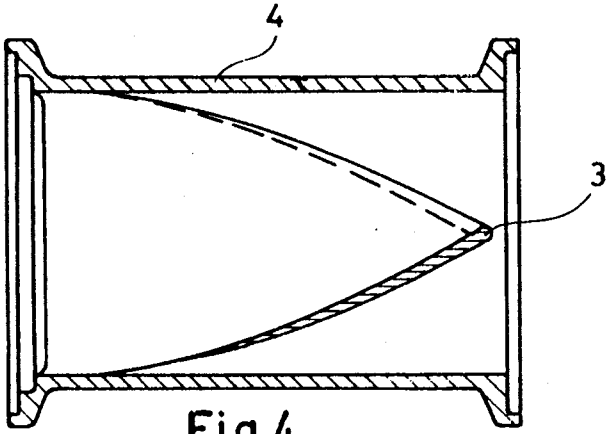
FIG. 4 is a view in horizontal section of the mixer of FIG. 3 taken along the line IV—IV of FIG. 3.

A static mixer according to the invention is built up of units and an embodiment of such a mixer is shown in FIGS. 3–6, which also show four different sections in such a unit. A twisted mixing element may be arranged, as is seen in FIG. 3, within a tube part 4. The tube part 4 is in both its ends provided with flanges 5, 5' and guiding means which guarantee the correct assembly. The mixing element 1 is arranged somewhat displaced in relation to the front edge of the tube part in order to create a free space between the different mixing elements, when the tube parts are connected to a mixer. As is seen in the embodiment shown in FIGS. 3–6 the mixing element is firmly connected to the tube part along its whole length of extension. The thinner rear part 3 of the mixing element is twisted 90° in relation to the front part which is seen in FIGS. 5 and 6. The flow of media which enters into the tube part 4 is divided into two partial streams. Also the rear part of the mixing element ends inside the flanges of the tube part. With such an arrangement particles or fibres are less likely to get caught. The connections between the inner wall of the tube and the twisted wing are suitably manufactured with a bending of at least 2 mm preferably 3–5 mm radius in order to prevent objects get stuck and in order to facilitate cleaning.

In order to ensure that the tube parts are arranged in such a way that a unit with a mixing element which is twisted clockwise is followed by a unit with a counterclockwise twist there are notches and projections in the flanges of the tube units. In the tube part 4 there is a small notch 6 in the flange 5' and a larger notch 7 in the flange 5. The tube parts with the other kind of twist have corresponding projections which fit into the notches. Providing the tube parts with notches and projections of different sizes also ensures that the thicker front portion of the mixing element is the first to be met by the product media.

Figure 7:
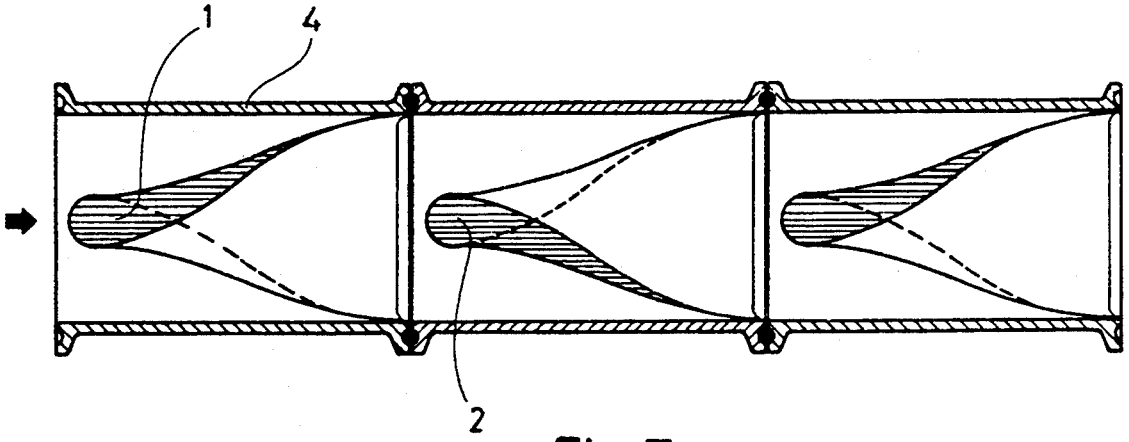
FIG. 7 shows how the units of FIGS. 3–6 are connected to a part of a static mixer according to the invention, FIG. 8 provided with a is a view in vertical section showing how a mixer according to the invention may be surrounding jacket in order to function as a steam injection heater simultaneously with the mixing.

In FIG. 7 there is shown how three tube parts are connected to a part of a static mixer according to the invention. The first unit is twisted clockwise, the second counter clockwise and the third clockwise again.

With such a connection of the mixing elements there is obtained an optimum use of the available space. As may be seen from the drawing there is a certain distance between the front part of the next mixing element and the rear part of the previous element. This distance is suitably 3–7 mm.

Figure 8:
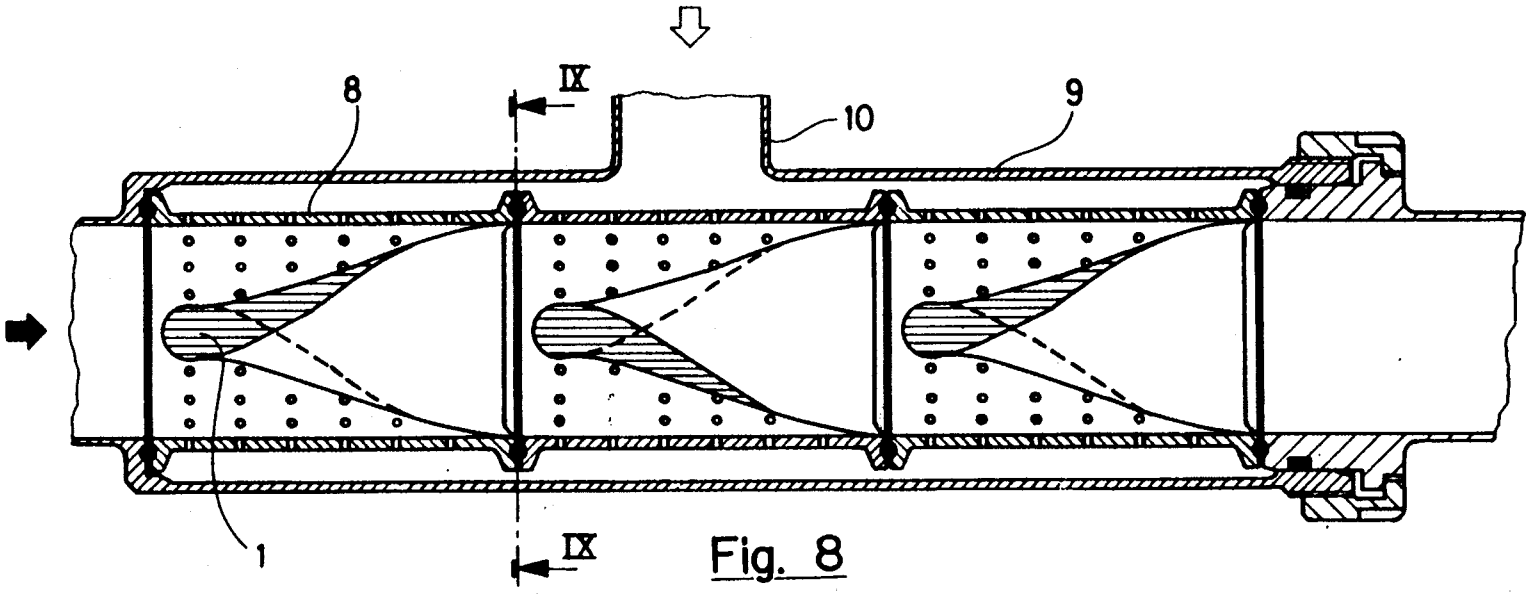
Figure 9:
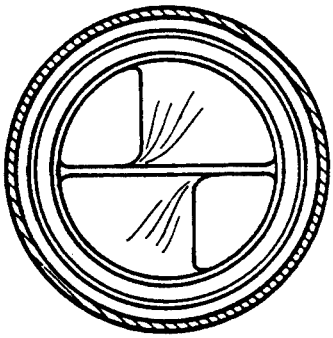
FIG. 9 is a cross-section of the mixer of FIG. 8 along the line IX—IX of FIG. 8.

Finally there is shown in FIGS. 8 and 9 a combined static mixer and steam injection heater. By drilling a number of small holes (0.5–3 mm) in the tube 8 and surrounding the tube parts with a further tube 9 provided with an inlet conduit 10 for steam there is obtained a good mixing and condensation of steam with simultaneous mixing. Such a combined mixer and steam injection heater is especially suitable for highly viscous or particle and fibre-rich liquids.

A static mixer of the kind described above is especially suitable for mixing two media each of which has passed a separate pasteurization and which are to be mixed prior to packaging. One of the media products may consist of soup containing particles while the other consists of a sauce, i.e. mainly a liquid product. Due to the difficulties of heat treating food products comprising particles correctly one tries, where it is possible, to limit the amount which is to pass this difficultly calculated treatment and with advantage a liquid phase is separated off prior to the heat treatment. The liquid may then be heat treated on its own. Remixing of the products takes place after the heat treatment.

Another mixing operation which may advantageously be carried through in the mixer according to the invention consists in mixing of gas in order to get fluffy and foaming food products.

A static mixer according to the invention comprises usually 10–12 mixing units. Due to the modular construction it may easily be adapted to different mixing operations. In certain cases an incomplete mixing may be desirable if for example jam is to be mixed into a yoghurt gel.

The mixing units are advantageously manufactured by casting or injection moulding of stainless steel or some plastic material allowed for foods, for example, polysulphone or polyetheretherketone, if the mixer is used for food applications.

What is claimed is:

1. A static mixer comprising a tube having an upstream end and a downstream end and built up from a plurality of tubular parts, each said tubular part containing at least one mixing element, said mixing elements having a longitudinal axis, a front end, a rear end and two side edges, said mixing elements further having the cross section of an airfoil with the front end being thicker than the rear end, said mixing elements being twisted about the longitudinal axis thereof, said mixing elements being positioned in said tubular parts with the side edges thereof secured to said tubular parts and the front ends thereof facing the upstream end of the tube.

2. A static mixer according to claim 1 wherein the tubular parts are designed so that the mixing elements (1) are arranged at a distance from each other, to create a free space between the mixing elements.

3. A static mixer according to claim 1, characterized in that each said mixing element (1) is twisted 80°–100°.

4. A static mixer according to claim 1, characterized in that every second mixing element (1) is twisted counter clockwise while every other element is twisted clockwise.

5. A static mixer according to claim 1, characterized in that the front ends of said mixing elements have a mainly semicircular profile.

6. A static mixer according to claim 5, wherein said mixing elements have a continuously narrowing form in profile.

7. A static mixer according to claim 1 wherein said tubular parts have 5–15 mixing elements.

8. A static mixer according to claim 7 wherein said tubular parts have 10–12 mixing elements.

9. A static tube mixer according to claim 1 wherein the tube has inner and outer tube walls (9, 10) the inner tube wall (9) being perforated for introduction of a heating medium.

10. A static mixer according to claim 1 wherein each said tubular part is provided with flanges, said flanges having guide means to ensure correct assembly.

* * * * *

UNITED STATES PATENT AND TRADEMARK OFFICE

CERTIFICATE OF CORRECTION

PATENT NO. : 5,425,581

DATED : Jun. 20, 1995

INVENTOR(S) : Bengt Palm

It is certified that error appears in the above-indentified patent and that said Letters Patent is hereby corrected as shown below:

| | | |
|---|---|---|
| Col. 1, | lines 16, 17, | cancel "from the beginning" (second occurrence). |
| | line 23, | cancel "other things". |
| | line 24, | after "among", cancel "all" and substitute --other things--. |
| Col. 2, | line 9, | after "flow", insert --paths--. |
| Col. 3, | line 37, | cancel "provided with a". |
| | line 39, | after "be", insert --provided with a--. |
| Col. 4, | line 19, | cancel "get" and substitute **--getting--**. |

UNITED STATES PATENT AND TRADEMARK OFFICE

CERTIFICATE OF CORRECTION

PATENT NO. : 5,425,581 Page 2 of 2

DATED : Jun. 20, 1995

INVENTOR(S) : Bengt Palm

It is certified that error appears in the above-indentified patent and that said Letters Patent is hereby corrected as shown below:

| | | |
|---|---|---|
| Col. 6, | lines 3, 4, | (claim 3) cancel "characterized in that" and substitute --wherein-- |
| | lines 5, 6, | (claim 4) cancel "characterized in that" and substitute --wherein-- |
| | lines 9 & 10, | (claim 5) cancel "characterized in that" and substitute --wherein-- |

Signed and Sealed this

Tenth Day of October, 1995

*Attest:*

Bruce Lehman

BRUCE LEHMAN

*Attesting Officer*

*Commissioner of Patents and Trademarks*